United States Patent [19]

Bronner et al.

[11] 4,246,049

[45] Jan. 20, 1981

[54] PROCESS FOR THE THERMAL TREATMENT OF FE-CO-CR ALLOYS FOR PERMANENT MAGNETS

[75] Inventors: Claude Bronner, Uriage; Daniel Jullien, St. Martin-d'Heres, both of France

[73] Assignee: Aimants Ugimag S.A., Saint-Pierre-d'Allevard, France

[21] Appl. No.: 3,025

[22] Filed: Jan. 12, 1979

[30] Foreign Application Priority Data

Jan. 19, 1978 [FR] France ..... 78 02104

[51] Int. Cl.[3] ..... H01F 1/02

[52] U.S. Cl. ..... 148/103; 148/31.57; 148/121

[58] Field of Search ..... 148/31.57, 101, 103, 148/108, 121, 158

[56] References Cited

U.S. PATENT DOCUMENTS

| | | | |
|---|---|---|---|
| 2,298,225 | 10/1942 | Nesbitt | 148/31.57 |
| 3,806,336 | 4/1974 | Kaneko et al. | 75/122 |
| 3,954,519 | 5/1976 | Inoue | 148/31.57 |
| 3,982,972 | 9/1976 | Iwata et al. | 148/121 |
| 4,008,105 | 2/1977 | Yuda et al. | 148/31.57 |

*Primary Examiner*—L. Dewayne Rutledge
*Assistant Examiner*—John P. Sheehan
*Attorney, Agent, or Firm*—Dennison, Meserole, Pollack & Scheiner

[57] ABSTRACT

A process for the thermal treatment of an Fe-Co-Cr alloy for a permanent magnet, constituted by weight of 10 to 40% of Cr, from 0 to 10% of one or more elements of the group Al, Nb, Ta, W, Mo, V, Ti, Si and Cu, the remainder being iron. The process comprises homogenization treatment at between 1200° and 1400° C., an annealing treatment and one or more tempering treatments at between 500° and 600° C.; the annealing treatment comprises two stages, the first at between 630° and 670° for 5 to 30 minutes, the second, without a return to ambient temperature, at a temperature of from 40° to 70° C. below the previous stage for at least 10 minutes.

Isotropic or anisotropic magnets whose hysteresis curve exhibits a better rectangular shape are thus obtained.

3 Claims, 1 Drawing Figure

PROCESS FOR THE THERMAL TREATMENT OF FE-CO-CR ALLOYS FOR PERMANENT MAGNETS

Figure 1:
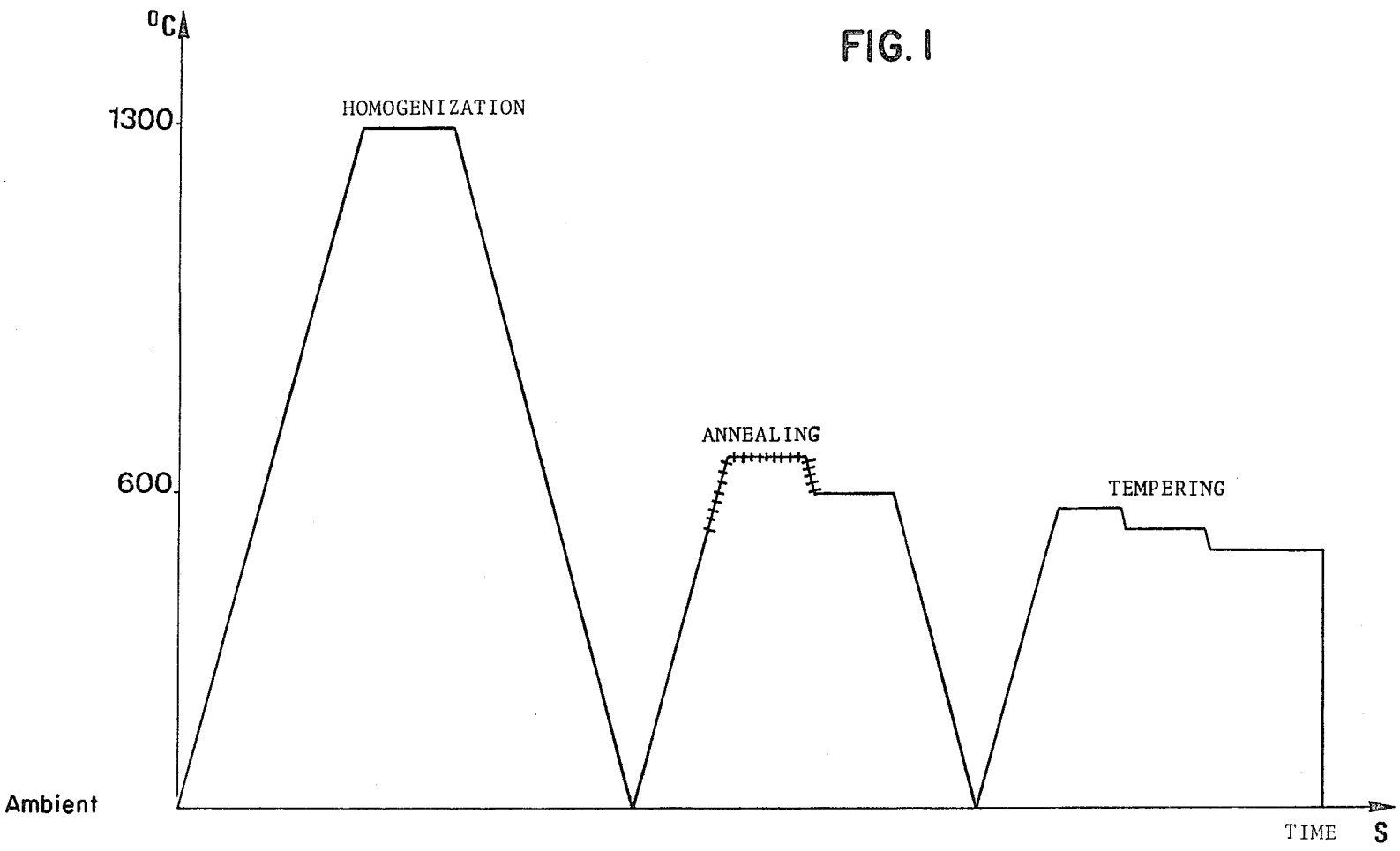

The present invention relates to a process for the thermal treatment of Fe-Co-Cr alloys intended for the manufacture of permanent magnets as well as the magnets produced by this process. These alloys are of the following composition (by weight): Co, 10 to 40%, Cr, 10 to 40%, optionally one or more of the elements, Al, Nb, Ta, W, Mo, V, Ti, Si, Cu in a total quantity of less than 10%, the rest being iron.

French Pat. No. 2,149,076 describes various alloys of this type as well as the thermal treatments thereof. A first shape is cast and is subjected to a homogenization treatment at a high temperature of between 1200° and 1400° C. for more than 10 minutes, followed by rapid quenching to ambient temperature. At this stage, the cast body can be subjected without particular difficulty to various shaping operations such as rolling, drilling, machining etc., to bring it to a shape near to the final shape.

The body is then subjected to an isothermal annealing treatment in a magnetic field at a temperature of between 580° and 650° C., (preferably from 600° to 640° C.) for a period of from 10 minutes to 2 hours, but preferably of the order of 30 minutes. After the return to ambient temperature, the article is subjected to one or more tempering treatments at temperatures of between 530° and 650° C. for 1 to 9 hours, these tempering treatments possibly being carried out at temperatures which decrease in stages.

It is thus observed that these various tempering treatments tend to diminish the rectangular shape of the hysteresis cycle measured by the ratio $\eta$ between the maximum specific energy BH max and the product Br Hc of the residual induction by means of the coercive field.

On the other hand, if a maximum specific energy BH max above $5 \cdot 10^6$ Gauss-Oersteds is to be obtained, it is necessary to proceed with an additional working operation (rolling or forging) causing a reduction of the transverse section of the article, as demonstrated by Example 12 of the above-mentioned French Patent. Experience has shown that in numerous cases this operation causes the article to crack or break owing to the fact that the alloy is two-phased and brittle at this stage.

The object of the present invention is to avoid these disadvantages and to allow the manufacture of anisotropic permanent magnets of the Fe-Cr-Co type having a constant coefficient $\eta$ of rectangularity of the hysteresis curve during the tempering treatments, the specific energy of which can exceed $5 \cdot 10^6$ Gauss-Oersteds without an additional working operation and, therefore, without risk of breakage.

It can also allow the manufacture of isotropic permanent magnets whose hysteresis curve is of greater rectangularity than that obtained with the known treatments.

The invention involves carrying out the annealing treatment following quenching after homogenization in two stages:

(a) A first stage at a temperature of between 630° and 670° C. for a period of between 5 and 30 minutes, (b) A second stage immediately afterwards, without a return to a low temperature, at a temperature of from 40° to 70° C. below the previous stage for at least 10 minutes.

The first stage is of sufficiently short duration to avoid the precipitation of the brittle $\sigma$ phase in the alloy. The temperature maintained during this first stage is of between 640° and 660° C.

The tempering treatment is preferably carried out in three stages of increasing duration at temperatures in decreasing stages of about 30° C. These stages can be linked or separated by returns to ambient temperature.

In order to produce anisotropic permanent magnets, a magnetic field in which the curvature of the field lines is suitable for the intended application of the magnet is applied during the first stage of the annealing treatment. The second stage of the annealing treatment may be carried out with or without the action of a magnetic field.

Of course, the annealing treatment does not comprise any action of a magnetic field for obtaining isotropic magnets.

The alloys produced in the process according to the invention may be obtained in various manners, for example by fusion of the constituent elements in the pure state or in the pre-alloyed state, or by sintering of pulverulent mixtures of the constituent elements or of alloys of these elements. The process can also be applied to alloys to which a priviledged crystalline structure has been imparted by known means (thermal gradient, zone melting, etc.).

The invention will be illustrated by the following embodiments and by the single FIGURE which shows a diagram of the thermal treatment of an alloy according to the invention for obtaining an anisotropic magnet, the hatched part of the curve of FIG. 1 representing the zone of time and temperature where it is necessary to apply a magnetic field.

EXAMPLE 1

A Fe-Co-Cr alloy having the following composition by weight: Co, 20%; Cr, 29%; W, 0.5%; Fe, remainder is cast and it is subjected to the following thermal treatment, shown diagrammatically in the figure.

(1) Homogenization at 1300° C. followed by water quenching to ambient temperature, (2) Heating to 655° C. and maintenance for 15 minutes in the presence of a magnetic field of 2000 Oersteds, (3) Cooling in 5 minutes, in the presence of a magnetic field, to 600° C., (4) Maintenance at 600° C. for 15 minutes without a magnetic field, (5) Water-quenching or air cooling to ambient temperature, (6) Staged temperings of 1 hour 30 minutes at 580° C. then 5 hours at 550° C. then 15 hours at 520° C.

The treatment according to the prior art in which the temperature is decreased to 400° C. in 15 minutes after the stage of 15 minutes at 655° C. is carried out as a comparison. The magnetic characteristics of the magnet obtained are measured in each case and the ratio is established:

$$\eta = \frac{(BH)\ \max}{BrHc}$$

The results have been compiled in Table I in which

A and B designate the experiments in which annealing was performed according to the invention in two stages, C and D designate the experiments carried out with the comparison treatment, 1, 2 and 3 designate the measurements taken after annealing, after the second tempering treatment and after the third tempering treatment respectively.

These results show clearly that anisotropic magnets having a specific energy above $5 \cdot 10^6$ Gauss-Oersteds and a coefficient $\eta$ above 0.60 are obtained with the process according to the invention. This was not possible with the process according to the prior art without an additional working operation. Moreover, the durations of the treatment are reasonable and do not raise the cost price. (See Table I on page 8.)

EXAMPLE 2

Similarly, an identical treatment according to the invention was applied, but this time in the absence of a magnetic field, to produce isotropic magnets, and a comparison treatment according to the prior art which is identical to the preceding case but without a magnetic field was applied.

The results are shown in Table II in which the test in which annealing was performed according to the invention is designated by A' and the test in which the annealing treatment was performed in accordance with the prior art is designated by C', the indices 1, 2 and 3 having the same meaning as above.

TABLE II

| Test | $A_1'$ | $A_2'$ | $A_3'$ | $C_1'$ | $C_2'$ | $C_3'$ |
|---|---|---|---|---|---|---|
| Br | 8500 | 8900 | 9050 | 9500 | 8850 | 9000 |
| Hc | 520 | 630 | 615 | 335 | 560 | 560 |
| BHmax | 1.90 | 2.20 | 2.25 | 1.35 | 1.70 | 1.75 |
| $\eta$ | 0.41 | 0.39 | 0.40 | 0.42 | 0.34 | 0.35 |

TABLE I

| Test | A1 | A2 | A3 | B1 | B2 | B3 | C1 | C2 | C3 | D1 | D2 | D3 |
|---|---|---|---|---|---|---|---|---|---|---|---|---|
| Br Gauss | 11800 | 12000 | 12400 | 11900 | 12000 | 12300 | 12000 | 11600 | 12000 | 12000 | 11800 | 12100 |
| Hc Oersted | 565 | 680 | 670 | 550 | 675 | 665 | 440 | 740 | 735 | 410 | 680 | 680 |
| (BH) max $10^6$ Gauss-Oersted | 4.25 | 5.25 | 5.30 | 4.15 | 5.05 | 5.10 | 3.10 | 4.30 | 4.40 | 3.00 | 4.05 | 4.15 |
| $\eta = \frac{(BH)\ max}{BrHc}$ | 0.64 | 0.64 | 0.64 | 0.63 | 0.62 | 0.62 | 0.58 | 0.52 | 0.49 | 0.60 | 0.50 | 0.50 |

It is observed that the treatment A according to the invention substantially improves the magnetic properties of an isotropic magnet, in particular with regard to the rectangular shape of the hysteresis curve.

EXAMPLE 3

A composition formed (by weight) of 17% Co, 26% Cr, 0.5% W, the remainder being essentially iron, has been treated in the following manner:

homogenization at 1320° C. for 1 hour and water quenching, heating to 655° C. maintained for 15 minutes in the presence of a magnetic field of 2000 Oersteds, cooling in 5 minutes to 590° C. in the presence of the magnetic field, maintenance at 590° C. (without field) for 30 minutes and water quenching, three tempering treatments in stages of 1 hour 30 minutes at 580° C., then 5 hours at 550° C., then 15 hours at 520° C.

The results of the two tests carried out on this composition after annealing (1), after second tempering (2) and after third tempering (3), are as follows:

TABLE III

| | Test No. 1 | | | Test No. 2 | | |
|---|---|---|---|---|---|---|
| | 1 | 2 | 3 | 1 | 2 | 3 |
| Br Gauss | 13800 | 13900 | 14200 | 13800 | 13900 | 14200 |
| Hc Oersted | 275 | 575 | 570 | 270 | 575 | 590 |
| (BH)max MG-Oe | 2.90 | 5.70 | 6.10 | 2.60 | 5.70 | 5.90 |
| $\eta$ | 0.76 | 0.715 | 0.75 | 0.70 | 0.73 | 0.70 |

EXAMPLE 4

A composition comprising (by weight), 15% of Co, 24% of Cr, 1% W, the remainder being essentially iron, has been treated in the following manner:

homogenization at 1250° C. for one hour, followed by water quenching, heating at 670° C. and maintenance for 15 minutes in the presence of a magnetic field of 2000 Oersteds, cooling in 5 minutes to 590° C. (under field) and maintenance for 30 minutes (outside field) followed by water quenching (or air cooling) to ambient temperature, three tempering treatments in stages of 1 hour 30 minutes at 580° C., then 5 hours at 55° C., then 15 hours at 520° C.

The results obtained on two samples are recorded in Table IV below (with the same notations as in EXAMPLE 3):

TABLE IV

| | Test No. 3 | | | Test No. 4 | | |
|---|---|---|---|---|---|---|
| | 1 | 2 | 3 | 1 | 2 | 3 |
| Br Gauss | 15000 | 15000 | 15300 | 14700 | 14700 | 15000 |
| Hc Oersted | 155 | 520 | 560 | 180 | 540 | 570 |
| (BH)max MG-Oe | — | 6.10 | 6.50 | — | 5.95 | 6.40 |
| $\eta$ | — | 0.78 | 0.76 | — | 0.75 | 0.75 |

It can be observed that the slightly alloyed compositions (of Co and Cr) in Examples 3 and 4 have values of BH max and of $\eta$ which are much higher than those obtained with the charged alloys (Example 1) representing the prior art, and that the most weakly alloyed composition (Example 4) itself affords magnetic characteristics which are superior or equivalent to those of the alloy of intermediate composition (Example 3).

We claim:

1. A process for the thermal treatment of a Fe-Co-Cr alloy for a permanent magnet composed of by weight Co, 10 to 40%, Cr, 10 to 40%, one or more of the following elements Al, Nb, Ta, W, Mo, V, Ti, S; and Cu, 0 to 10%; Fe, remainder, comprising the steps sequentially of:

(a) homogenization at between 1200° and 1400° C. for at least 10 minutes;

(b) rapid quenching;

(c) annealing in two stages wherein the first stage is at a temperature of between 630 and 670° C. for a period of between 5 and 30 minutes and wherein the second stage follows immediately after the first stage without reduction to ambient and occurs at a temperature of from 40° to 70° C. below the first stage and for at least 10 minutes;

(d) applying a magnetic field to the alloy at least during the first annealing stage; and, (e) at least one tempering treatment at temperatures between 500° and 600° C.

2. A process according to claim 1 wherein the temperature of the first annealing stage is between 640° and 660° C.

3. A process according to claim 1 wherein the tempering treatment (e) occurs subsequent to said second stage and wherein the tempering treatment is conducted in three stages of increasing duration at temperatures which decrease for each stage by approximately 30° C.

* * * * *